US007530120B2

(12) United States Patent
Morrow et al.

(10) Patent No.: US 7,530,120 B2
(45) Date of Patent: May 12, 2009

(54) PROTECTIVE GLOVE HAVING A PADDED PALMLESS OUTER GLOVE AND FORM-FITTING INNER GLOVE

(75) Inventors: David Morrow, Metamora, MI (US); Matthew Winningham, Birmingham, MI (US)

(73) Assignee: Warrior Sports, Inc., Warren, MI (US)

( * ) Notice: Subject to any disclaimer, the term of this patent is extended or adjusted under 35 U.S.C. 154(b) by 244 days.

(21) Appl. No.: 11/385,072

(22) Filed: Mar. 21, 2006

(65) Prior Publication Data

US 2006/0206981 A1 Sep. 21, 2006

Related U.S. Application Data

(60) Provisional application No. 60/663,948, filed on Mar. 21, 2005.

(51) Int. Cl.
*A41D 19/00* (2006.01)

(52) U.S. Cl. ..... 2/161.1; 2/20

(58) Field of Classification Search ..... 2/16, 2/20, 161.1, 164, 161.8
See application file for complete search history.

(56) References Cited

U.S. PATENT DOCUMENTS

| | | | | |
|---|---|---|---|---|
| 3,037,209 | A * | 6/1962 | Applegate, Jr. et al. | 2/20 |
| 4,355,424 | A * | 10/1982 | McCoy, Jr. | 2/16 |
| 4,662,006 | A * | 5/1987 | Ross, Jr. | 2/158 |
| 4,947,486 | A * | 8/1990 | Hsuih | 2/164 |
| 5,329,639 | A * | 7/1994 | Aoki | 2/161.1 |
| 5,548,844 | A * | 8/1996 | Ceresia | 2/161.7 |
| 6,550,069 | B1 * | 4/2003 | Morrow | 2/161.1 |
| 6,813,780 | B2 * | 11/2004 | Morrow | 2/161.1 |

* cited by examiner

*Primary Examiner*—Katherine Moran
(74) *Attorney, Agent, or Firm*—Warner Norcross & Judd LLP

(57) ABSTRACT

A protective sports glove consisting of a padded outer glove and an inner form-fitting glove. The padded outer glove is similar to conventional protective gloves used in contact sports, but having a substantial portion of the palm removed (i.e. except for the finger palm portions). The smaller form-fitting glove is introduced to the wearer's hand prior to insertion within the padded outer glove and covers the cutout palm portion of the padded outer glove. In essence, the form-fitting glove acts as the palm portion for the padded outer glove.

17 Claims, 4 Drawing Sheets

PROTECTIVE GLOVE HAVING A PADDED PALMLESS OUTER GLOVE AND FORM-FITTING INNER GLOVE

CROSS REFERENCE TO RELATED APPLICATION

The present invention claims priority from U.S. Provisional Patent Application Ser. No. 60/663,948, filed Mar. 21, 2005, and entitled "Palmless Protective Glove Having An Inner Palm."

TECHNICAL FIELD

The present invention relates generally to a protective glove for use in contact sports such as hockey or lacrosse and, more particularly, to a protective glove having a padded palmless outer glove and a form-fitting inner glove.

BACKGROUND OF THE INVENTION

In contact sports, such as lacrosse or hockey, where sticks are essential elements of the game, a player's hands and wrists are especially vulnerable to injury when being checked by another player's stick. For this reason, players typically utilize padded gloves to protect their hands, wrists and lower forearms during play.

The glove generally comprises a hand portion coupled to a plurality of finger portions and a thumb portion. The hand portion, finger portions and thumb portion each have a respective palm portion and a protective back having a plurality of pads disposed thereon. The gloves typically have a protective cuff that is coupled to a lower edge of the hand portion and extends below the back portion to protect the wearer's wrist and forearm.

The palm portion extends to cover the fronts of the thumb and fingers of the wearer's hand. The palm portion of the glove is formed from a durable material such as leather or synthetic leather. Obviously other suitable materials may be utilized. The palm portion may be reinforced with an additional durable material in high use areas and may also utilize mesh areas in lower use areas designed to provide ventilation to the wearer's hand without significantly affecting the durability of the glove.

The rules in the sports of hockey and lacrosse state that a glove must contain a palm portion that covers the inside of the wearer's palm, fingers, and thumb. Indeed, it is known that some players have cut out the hand portion of the palm for improved feel of the stick. However, this is illegal, as it leaves the palm of a player's hand exposed and therefore susceptible to injury. It is therefore desirable to provide a protective glove that provides a player with improved feel of the stick and improved ventilation without rendering the glove illegal.

SUMMARY OF THE INVENTION

Accordingly, the present invention provides a protective sports glove consisting of a padded outer glove and an inner form-fitting glove. The padded outer glove is similar to conventional protective gloves used in contact sports, but having a substantial portion of the hand palm portion removed (i.e. the finger palm portion and thumb palm portion remain intact). The smaller form-fitting glove is introduced to the wearer's hand prior to insertion within the padded outer glove and covers the removed or missing palm portion of the padded outer glove. In essence, the form-fitting glove acts as the palm portion for the padded outer glove.

The hand palm portion, or lower palm region, of the outer padded glove preferably covers a portion of the palm located near to the fingers and wrists while leaving an area of the palm nearer to the wrist exposed. In alternative versions, the durable material of the lower palm region may extend further down the wearer's hand towards the wrist. Additionally, one or more openings may be formed in the finger and thumb palm portions, or in a portion of the lower palm region, that are covered with a mesh or other breathable material to provide additional ventilation to the wearer's hand. The mesh portions are located in areas not intended to primarily contact the stick during play.

In another alternative version, the lower palm region of the padded outer glove may be formed with the durable portion covering all or most of the wearer's hand but having perforations such that small portions of the palm may be removed by the wearer, depending upon the level of "feel" to the stick desired.

The form-fitting glove adds versatility to the wearer by providing a glove in many different forms, depending upon the playing conditions. For example, on warmer days, the inner form-fitting glove may be formed from thinner durable materials. On colder days, the material may use thicker material. Also, a tackified form-fitting glove may be worn on rainy days to improve grippage on the stick. In addition, a wearer may replace the inner form-fitting glove during breaks in place to adjust to ever changing playing conditions. The form-fitting glove may be tipless, or may fit around the tips of the fingers and thumb depending upon the wearer's preference.

Alternatively, the form-fitting glove covers only the palm and a portion of the player's fingers. Other alternative versions of the glove may be formed wherein the back portion has a hook and loop fastening system, or other fastening device, to secure the back of the inner glove snugly around the back of the wearer's hand. Further, a hook and loop fastener may be attached to the exterior of the form-fitting glove and within the portion of the palm remaining to prevent the palm portion from bunching upward into the finger portions during play. Other mechanisms for securing this form-fitting glove to the outer glove may be utilized, including permanent and releasable (i.e. hook and loop) attachment mechanisms.

The form-fitting inner glove offers a wearer outstanding feel as compared with gloves having bulkier, less form-fitting palm portions. In other words, the protective glove of the preferred embodiments described herein having the form-fitting inner glove may actually improve playability as compared with traditional palmed gloves by allowing the wearer more intimate contact with the lacrosse or hockey stick.

In addition, the disclosed palmless glove reduces costs associated with replacing or repairing gloves having worn out palms. A wearer simply replaces the less costly form-fitting glove portion if it is worn out during play without being forced to purchase a more costly one-piece glove having a new palm portion or bear the cost and time necessary to replace the worn-out palm portion.

These and other features and advantages of the present invention will become apparent from the following description of the invention, when viewed in accordance with the accompanying drawings and appended claims.

DETAILED DESCRIPTION OF THE PREFERRED EMBODIMENT

Figure 1:
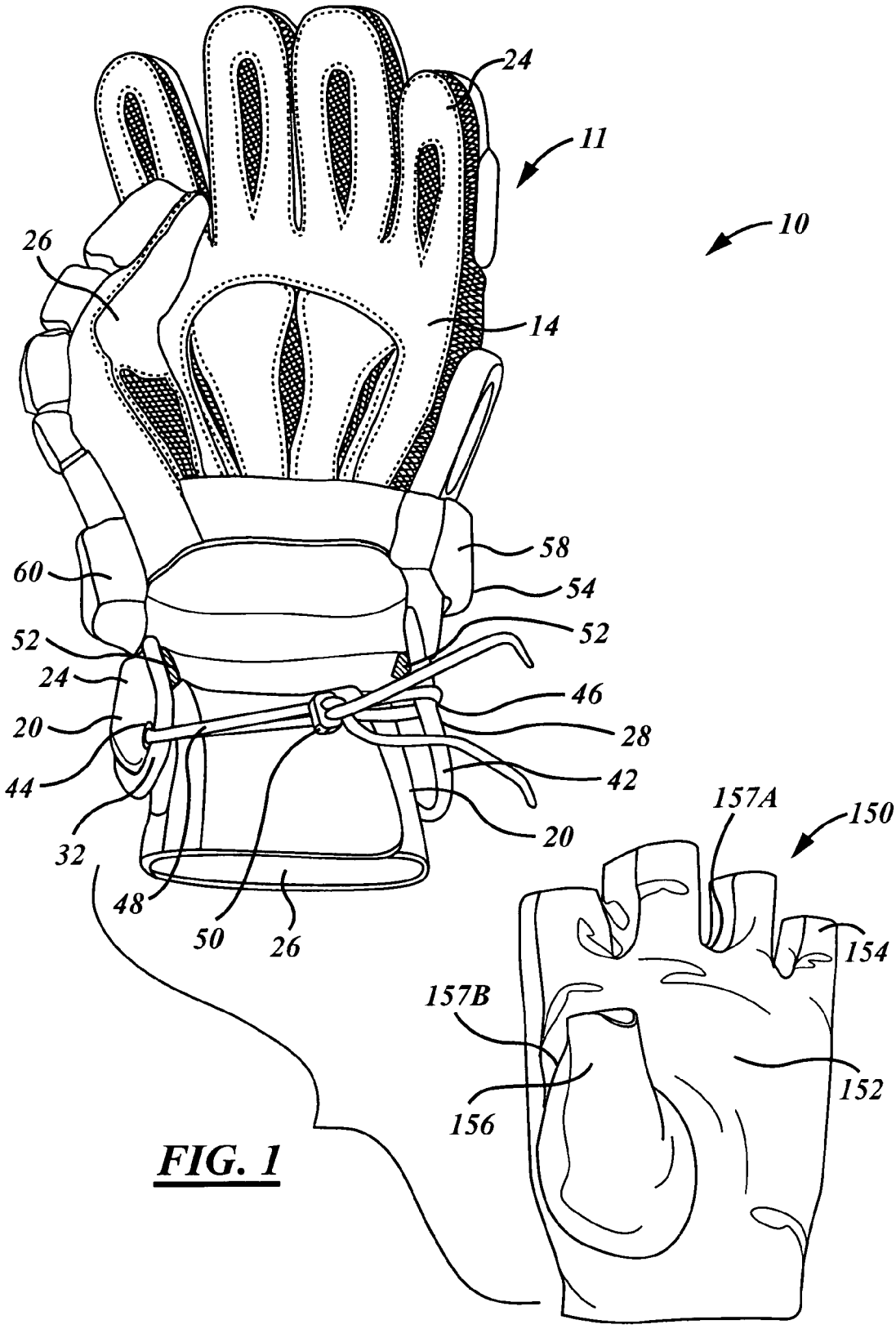
FIG. 1 is an exploded palm side view of a multi-portion protective glove having an outer padded glove portion and an inner form-fitting glove portion in accordance with a preferred embodiment of the present invention.

Referring now to the Figures, which illustrate a multi-piece protective glove 10 in accordance with the present invention. The drawings illustrate the left hand glove, however, it will be understood that the right hand glove has the same configuration, but opposite orientation. While the disclosed glove 10 is preferably for use in the game of lacrosse, it should be understood that the disclosed glove 10 might be used in a variety of other contact stick sports, including hockey. In one embodiment, the multi-piece protective glove 10 consists of two pieces, namely a padded outer glove 11 and an inner form-fitting glove 150.

The padded outer glove 11 has a hand portion 22 including a backside portion 12 and an opposing inner palm portion 14. The glove 10 preferably includes a cuff portion 20 coupled to a hand portion 22. The cuff portion 20 preferably has a first cuff segment 24, a second middle cuff segment 26, and a third cuff segment 28. The cuff portion 18 thus consists of multiple portions to provide a split cuff that yields increased flexibility for a wearer during play. It will be understood that the cuff portion 18 may be comprised of more or less segments as desired. The first cuff segment 24, the second middle cuff segment 26, and the third cuff segment 28 are each flexibly secured to the hand portion 22. They may also be flexibly secured to each other. A plurality of finger portions 24 and a thumb portion 26 are coupled to and extend from the hand portion 20.

The first edge portion 32 of the first cuff segment 24 preferably has an attachment mechanism 44 formed therein. Similarly, the second edge portion 42 of the third cuff segment 28 has a second attachment mechanism 46 formed therein. Each of the attachment mechanisms 44, 46 are preferably eyelets. Further, more than one attachment mechanism can be incorporated into each of the segments 24, 28 or the attachment mechanism can be formed in a variety of different locations. A lace 48 or other securing device is preferably passed through the first and second attachment mechanisms 44, 46 to connect the first cuff segment 24 to the third cuff segment 28. As shown, the lace 48 is intended to pass around the underside of a wearer's forearm such that the tightness of the cuff segments 24, 28 with respect to a wearer's forearm may be adjusted to bring the cuff segments 24, 28 closer to one another and bring the padding around a wearer's forearm. The lace 48 may be maintained in its desired position at a desired tightness through the use of the cord lock 50 or other similar locking device. Alternatively, the lace 48 may be removed from the glove entirely.

Figure 4:
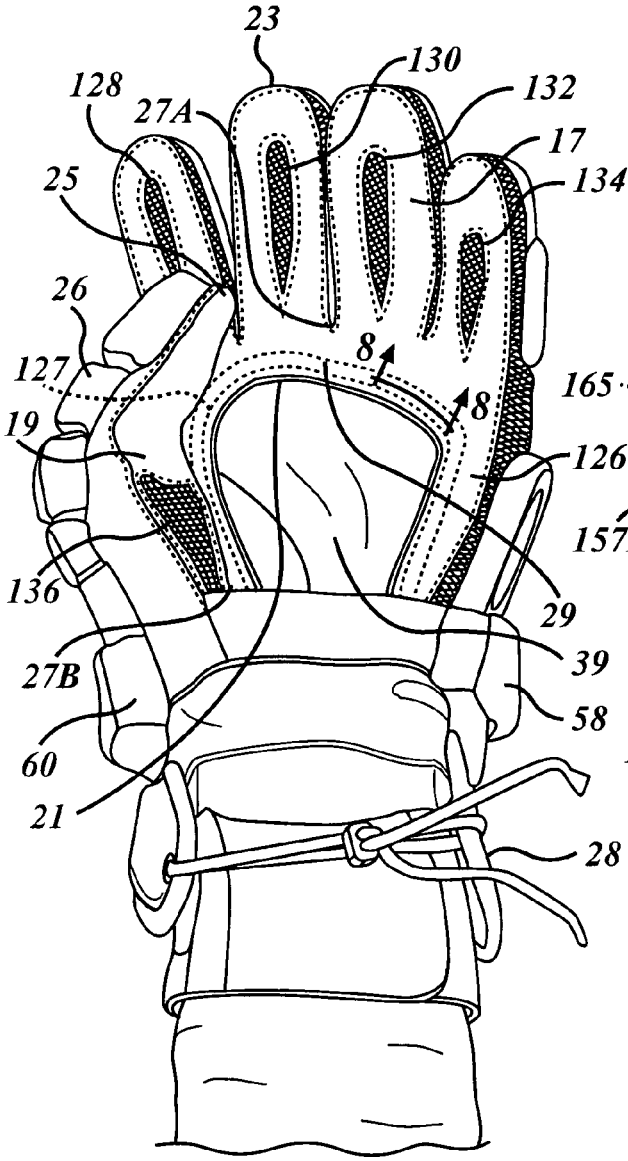
FIG. 4 is a palm side view of a protective sport glove of FIG. 1 coupled to a wearer's hand.

As best shown in FIG. 4, the cuff portion 20 is preferably secured to the hand portion 22 through a plurality of elastic members 52. Each of the elastic members 52 is preferably secured at one end to the upper border portion of the cuff portion 20 and at an opposing end to the hand portion 22. This configuration keeps the cuff portion 20 secured to the hand portion 22, but the elastic members 52 allow the cuff portion 20 to move with respect to the hand portion 22 and provide flexibility as the wearer's hand flexes during play. The elastic members 52 are preferably disposed adjacent on either side of the hand portion 22 with a third elastic member 52 preferably disposed generally in the middle of the backside to provide additional strength and flexibility. Other suitable materials such as neoprene or Lycra could also be utilized to secure the cuff portion 20 to the hand portion 22.

In the preferred embodiment, a wrist guard 54 is disposed over a seam portion defining the border of the cuff portion 20 and the hand portion 22 along the backside portion 12 of the hand portion 22. The wrist guard 54 is preferably a padded member and has a first end 58, which is preferably secured to the first cuff portion 28. The wrist guard 54 has a second end 60 that is preferably secured to the first cuff segment 24. While the first and second ends 58, 60 of the wrist guard 54 are preferably secured to the cuff portion 20 by sewing, it should be understood that the ends 58, 60 might be attached by any other known securing means. Alternatively, the wrist guard 54 could instead be secured to the hand portion 22. The wrist guard 54 is also preferably coupled to the hand portion 22 by an elastic member to allow some relative movement therebetween. However, other suitable connector materials such as neoprene or Lycra could also be utilized to secure the wrist guard 54 to the cuff portion 20 and/or hand portion 22.

The hand portion 22 extends between the seam portion and the plurality of finger portions 24. The backside portion 12 preferably has a plurality of protected padded portions secured thereto. As shown, the backside portion 12 is preferably subdivided into a plurality of individual protective padded portions 84, 86, 88, 90, 92, 94, 96, 98 separated by a series of cuts 99. The cuts 99 allow the glove to fit more comfortably as they allow the glove to better conform to a wearer's hand as he or she closes their hand around the stick. This is desirable as the back of a typical wearer's hand is not flat, and the padded protected portions are not flexible enough to bend without the cut portion 99. The cuts 99 are preferably formed in the outer glove 11 through die cutting or other known cutting or forming means, which are sufficient to configure the backside portion 12 of the glove to conform to the configuration described above. The backside portion 12 may have a variety of additional or different cuts not shown herein as desired. For example, the cuts 99 may be vertical cuts, horizontal cuts, or angled cuts, depending upon the desired flexion requirements for the glove 10.

The finger portions 24 are moveable with respect to the padded portions 88, 90, 94 and 96, allowing a wearer's fingers to flex. Each of the finger portions 24 also has one or more protective pads 98 thereon separated by one or more cuts 101. The cuts 101 allow the glove to fit more comfortably as they allow the glove to better conform to a wearer's finger as he or she closes their fingers around the stick. The cuts 101 are preferably formed in the outer glove 11 through die cutting or other known cutting or forming means.

The backside portion 12 of the hand portion 22 has a plurality of vent openings formed therein to provide ventilation to a wearer's hand. A first vent opening 106 is preferably disposed along the cut 99 between the protective padded portion 88 and the protective padded portion 90. A vent opening 108 is preferably disposed along another cut 99 between the protective padded portion 90 and the protective padded portion 92. Another vent opening 110 is preferably disposed along an angled cut 99 between protective padded portions 86, 88. In one embodiment, the vent openings 106, 108, 110 are located along the die cuts, which do not correspond to joints of the wearer's hand and, therefore while there is some relative movement of the protective pads in which the vent openings are formed, the movement is not sufficient to cause a portion of a wearer's hand to be exposed. It should be understood that while three vent openings 106, 108, 110 are disclosed on the backside portion 12 of the glove 10, any number of vent openings might be utilized. Additionally, the vent openings 106, 108, 110 may be disposed in a variety of other locations along the backside portion 12 in accordance with the preferred embodiment, including within or through the respective individual padded portions themselves, instead of along the die cuts.

The inner side 16 and the outer side 18 of the hand portion 22 connect the backside portion 12 to the inner palm portion 14. The inner side 16 has the thumb portion 26 extending therefrom. The outer side 18 of the glove preferably has a mesh layer 112 extending between the backside portion 12 and the inner palm portion 14.

Figure 3:
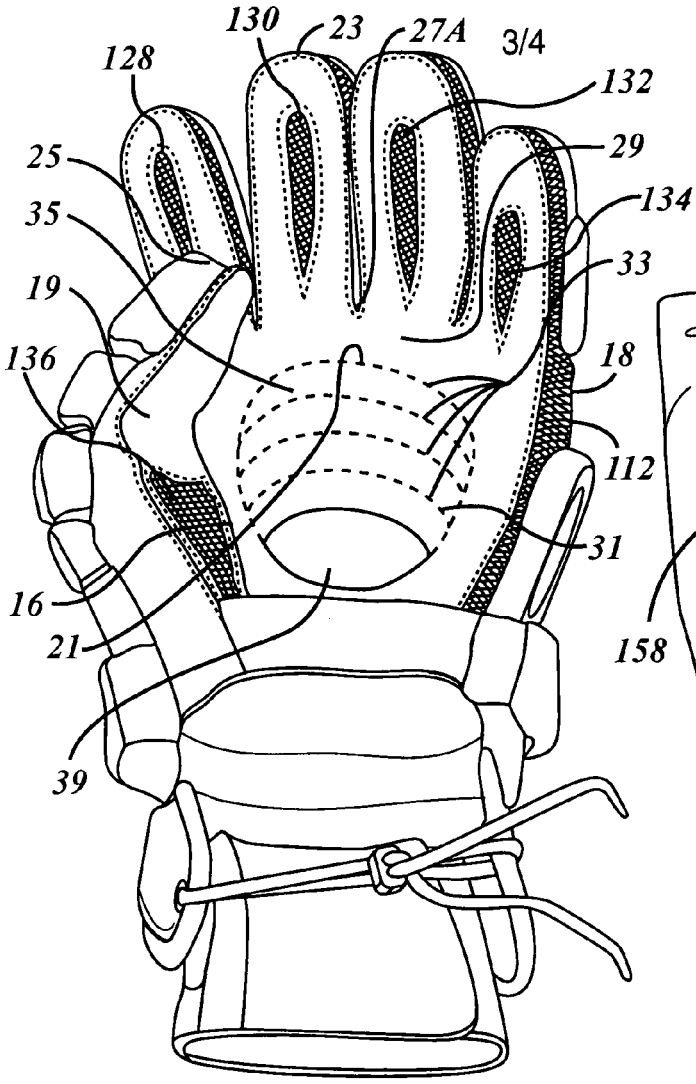
FIG. 3 is a palm side view of the outer padded glove according to a preferred embodiment of the present invention.

FIGS. 3 and 4 illustrate the inner palm portion 14 of the padded outer glove 11 in more detail. The inner palm portion 14 includes a lower palm region 29, which is coupled to, and preferably continuous with, the finger palm portion 17 and thumb palm portion 19. The finger palm portion 17 extends from the tips 23 of the finger portions 24 to the webbing 27A between the respective fingers, while the thumb palm portion 19 extends from the tip 25 of the thumb portion 26 to webbing 27B between the thumb and index finger. The lower palm portion 29 extends to a position slightly below the webbing 27A, 27B defined between each respective finger portion 24 and thumb portion 26. The length of the lower palm portion 29 extending away from the webbing 27 over the inner hand (between the fingers and the wrist) varies depending upon the amount of coverage desired by the wearer, with a majority of the wearer's palm extending towards the wrist being typically exposed below the lower border 21 of the lower palm region. The lower border 21 therefore defines the upper boundary of an opening that extends within the interior of the padded outer glove 11.

As shown, the inner palm portion 14, the finger palm portion 17, and the thumb palm portion 19 are each preferably comprised of a durable material such as leather, a synthetic material such as Nash leather, or any other known suitable material, generally illustrated by reference number 126. The finger mesh portions 128, 130, 132, and 134 and the thumb mesh portion 136 are preferably located throughout the inner palm portion 14, the finger palm portions 17, and/or the thumb palm portion 19 to provide ventilation to a wearer's palm and are located in areas that are not intended as primary contact areas for a stick.

In an alternative preferred embodiment, as best shown in FIG. 3, the durable material of the lower palm region 29 extends substantially further towards the wearer's wrist and is subdivided into one or more removable regions 35 defined individually between a series 33 of perforations 31 located at varying lengths from the webbing 27. Each of the series of removable regions 35 may be removed by tearing out the section along the respective perforations 31 to expose a greater area of opening 39.

Figure 5:
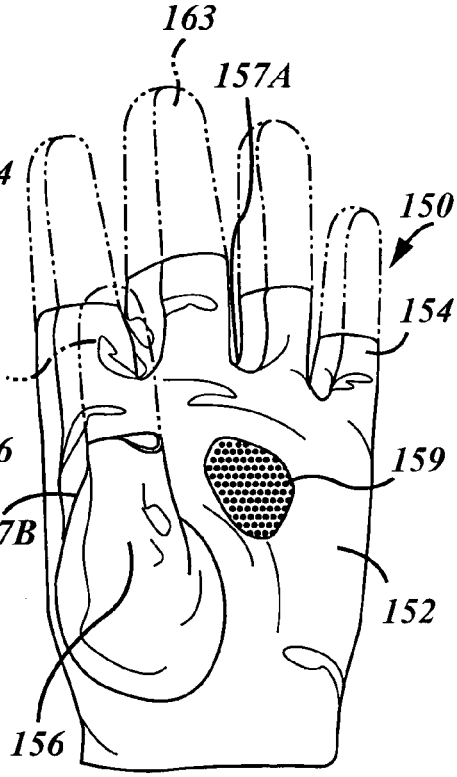
FIG. 5 is a palm side view of the inner form-fitting glove according to a preferred embodiment of the present invention.

Referring back now to FIGS. 1 and 2 and also to FIG. 5, an inner form-fitting glove 150 is shown that is used in conjunction with the outer padded glove 11. The form-fitting glove 150 adds versatility to the wearer by being available in many different forms, depending upon the playing conditions. The inner form-fitting glove need not be form fitting to the wearer's hand and still fall within the spirit of the present invention. In preferred embodiments, however, the inner glove is form fitting.

Figure 2:
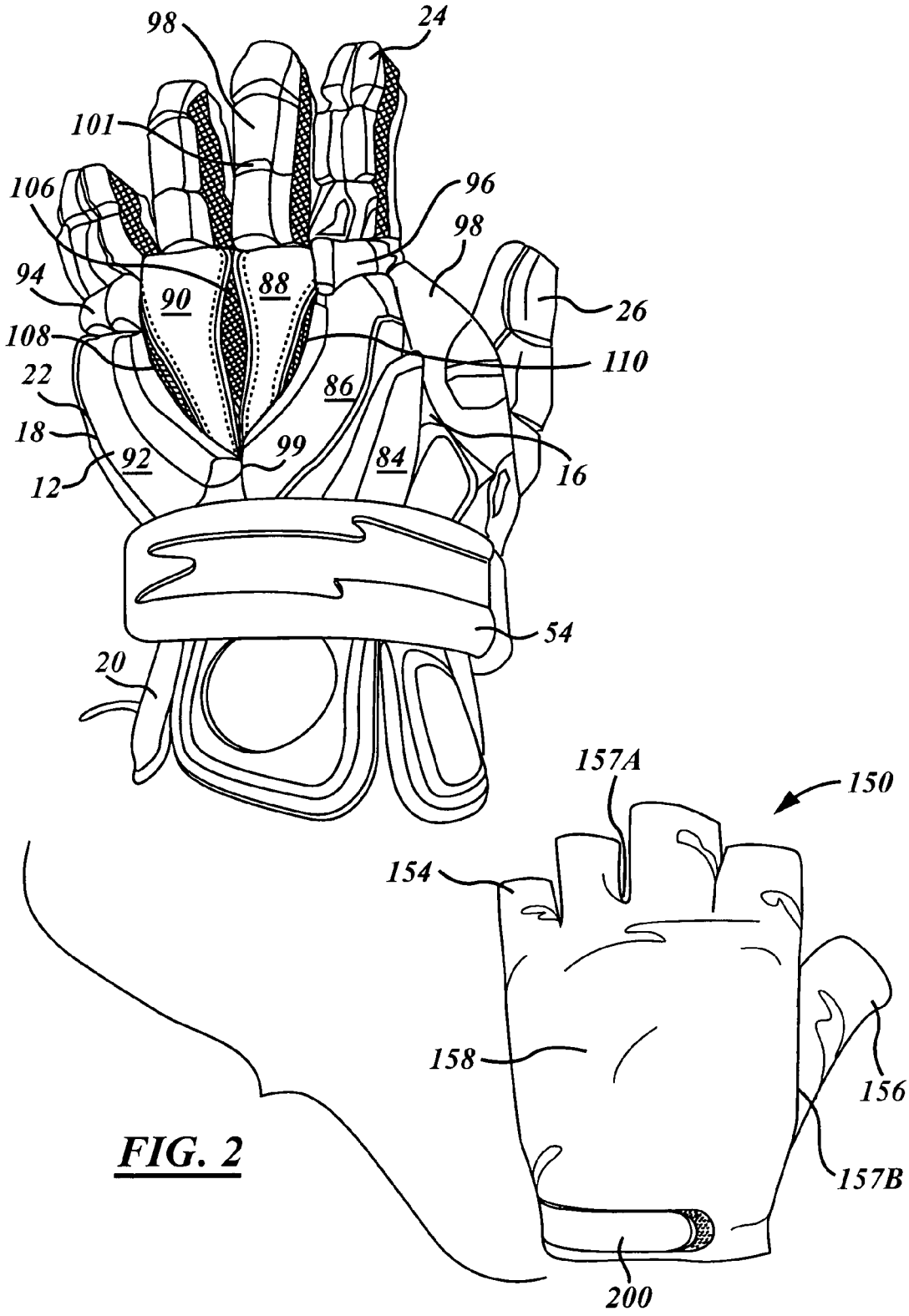
FIG. 2 is a back side exploded view of the protective glove of FIG. 1.

The inner form-fitting glove 150 includes a palm portion 152, a plurality of finger portions 154 and a thumb portion 156 each coupled to and extending from the palm portion 152. A back portion 158 is also shown coupled to the palm portion 152, the finger portions 154 and the thumb portion 158. The back portion 158 may optionally include a hook and loop fastening system 200 that aids in securing the inner form-fitting glove 150 tightly around the wearer's hand. In one preferred embodiment, as shown in FIGS. 2 and 5, the back portion 158 covers the entire back of the wearer's hand from the webbing 157A, 157B of the finger and thumb portions 154, 156 to the wrist area of the wearer.

Figure 6:
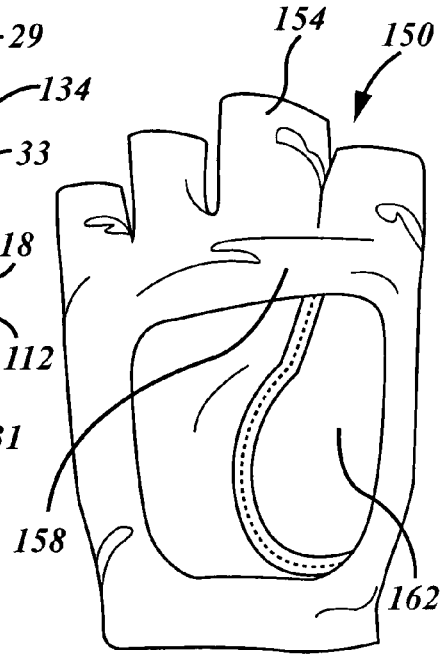
FIG. 6 is a back side view of the inner form-fitting glove according to one preferred embodiment of the present invention.

Alternatively, as shown in FIG. 6, the glove 150 may be substantially backless, thus having an opening 162, therein exposing most of the back of the hand to the back portion 12 of the outer glove 11 through an opening 122. Thus, for embodiments having vent openings 106, 108, 110 in the backside portion 12, direct air-cooling to the backside of the hand through the vent openings 106, 108, 110 of the outer glove 11 and opening 162 of the inner glove 150 is achievable.

The palm portion 152 of the inner form-fitting glove 150 of FIGS. 1, 2, and 5-6 is formed from a relatively thin, flexible material that is designed to provide maximum feel for a wearer to contact a stick such as a lacrosse stick or hockey stick. The palm portion 152 covers areas of the wearer's palm not covered by the overlying lower palm region 29 (i.e. within opening 39) of the padded outer glove 11. In other words, the palm portion 152 of the inner form-fitting glove 150 functions as the palm portion to comply with the rules regarding palm areas of gloves in the sports of ice hockey and lacrosse.

The material used in the form-fitting glove 150 preferably has a degree of durability sufficient to minimize ripping and tearing during use. The material also preferably is breathable or is formed with ventilation holes 160 to provide cooling airflow to the wearer's palm. One preferred material used in the palm portion 152 is natural leather or simulated leather such as synthetic Nash leather. However, other materials that may be utilized include cloth-like or fabric-like, breathable materials having a degree of durability. The material may even be elastic-like. Thus, the palm portion may be formed of natural or synthetic fabrics such as cotton, nylon, polyester, or other polymeric materials that are commonly used in the glove industry.

As stated above, the material used in the inner form-fitting glove 150 is designed to provide maximum feel to the wearer. However, the wearer may interchange between numerous materials and thickness depending upon the wearer's preference given numerous factors, including weather conditions. Thus, for example, on warmer days, the form-fitting gloves 150 may be formed from thinner durable materials. On colder days, the glove may use thicker material. Also, as shown in FIG. 5, an inner form-fitting glove 150 having a tackified region 159 may be introduced to the palm portion 152 on rainy days to improve grippage on the stick.

The form-fitting gloves 150 offer a wearer outstanding feel as compared with gloves having bulkier, less form-fitting palm portions. In other words, the inner form-fitting glove 150 may actually improve playability as compared with traditional palmed gloves by allowing the wearer more intimate contact with the lacrosse or hockey stick. Further, the form-fitting glove fulfills that current lacrosse and hockey requirements that a glove have a palm portion.

In addition, the multi-portion glove 10 reduces costs associated with replacing or repairing gloves having worn out palms. A wearer simply replaces the less costly form-fitting glove portion 150 if it is worn out during play without being forced to purchase a more costly padded outer glove.

Further, the multi-portion glove 10 offers the wearer the ability to easily modify the glove based on the varying weather conditions or breaks in play by simply selecting an alternative inner form-fitting glove 11 that is more appropriate for the given playing conditions as perceived by the wearer.

While the form-fitting gloves 150 of the preferred embodiments of the present invention do not typically cover the tips of the wearer's fingers and thumb, alternative preferred versions could include tips (shown as tip regions 163, and 165 in FIG. 5), depending upon the wearer's preference.

Figure 7:
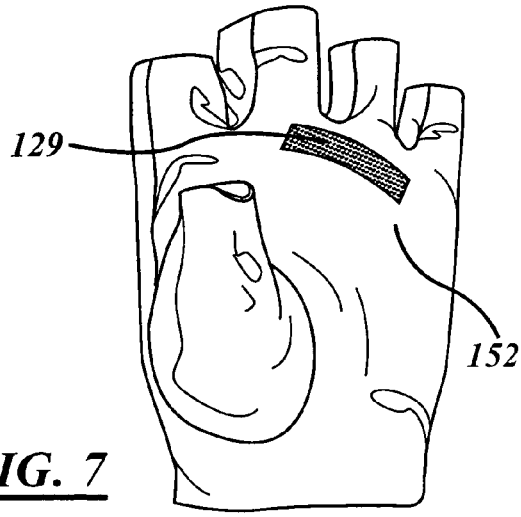
FIG. 7 is a palm side view of the inner form-fitting glove according to another preferred embodiment of the present invention.
Figure 8:
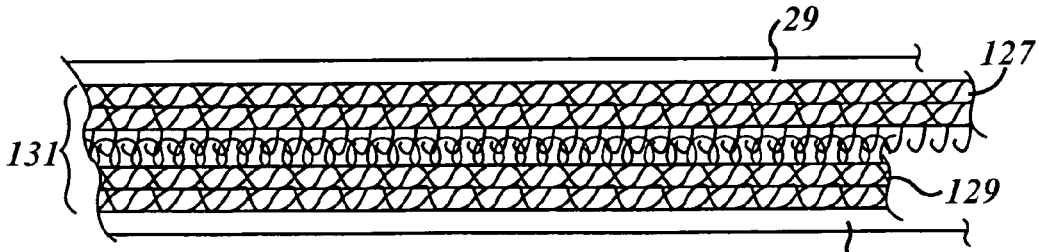
FIG. 8 is a section view of a portion of FIG. 4 taken along line 8-8.

Further, in another alternative preferred embodiment as shown in FIGS. 4, 7 and 8, a hook and loop fastening system 131 may be introduced to the outer glove 11 and the form fitting glove 150. The hook and loop fastening system 131 functions to prevent the palm portion 29 of the outer glove 129 from bunching upward into the finger portions 24 during play.

As best seen in FIG. 8, a male or female portion (here shown as the female portion 129) of a hook and loop fastening system 131 is sewn or otherwise attached to the palm portion 152 of the form-fitting glove 150. Further, as shown in FIGS. 4 and 8, a corresponding male or female portion (here shown as the male portion 127) is sewn on the interior side (i.e. side facing the backside portion 12) of the palm portion 29 at a location near the border 21. The male portion 127 is then coupled to the female portion 129 when the wearer inserts his or her hand within the interior outer glove 11.

While particular embodiments of the invention have been shown and described, numerous variations or alternate embodiments will occur to those skilled in the art. Accordingly, it is intended that the invention be limited only in terms of the appended claims.

What is claimed is:

1. A protective sports glove, comprising:

a padded outer glove having a hand portion, said hand portion comprising an inner palm portion and an opposing backside portion, said inner palm portion including a lower palm region having a lower border and said opposing backside portion including a plurality of pads disposed thereon, said inner palm portion defining a hole therein, said hole aligned with the palm of a wearer's hand;

a plurality of finger portions secured to and extending from said hand portion for receipt of a wearer's fingers therein, each of said plurality of finger portions including a finger palm portion and an opposing padded finger portion;

a thumb portion secured to and extending from said hand portion for receipt of a wearer's thumb therein, said thumb portion including a thumb palm portion and an opposing padded thumb portion; and a selectively removable inner glove coupled within said padded outer glove, said inner glove having a palm portion, said palm portion covering a wearer's palm and underlying said hole in said inner palm portion of said outer glove so that said palm portion of said inner glove is exposed through said hole in said outer glove, whereby said inner glove provides protection for the wearer's palm.

2. The protective sports glove of claim 1, wherein said inner glove further comprises a a wrist portion extending around a wearer's wrist to secure said inner glove to said wearer's hand independent of said outer glove.

3. The protective sports glove of claim 1, wherein said padded outer glove further comprises a plurality of vent openings formed in said backside portion of said hand portion.

4. The protective sports glove of claim 1, further comprising a wrist guard coupled to said hand portion.

5. The protective sports glove of claim 1 wherein said outer glove includes at least one mesh portion coupled within said inner palm portion, said finger palm portion, or said thumb palm portion, said at least one mesh portion located in an area not intended to primarily contact a stick during use.

6. The protective sports glove of claim 1, wherein said lower palm region includes at least one series of perforations, said at least one series of perforations defines a removable portion of said lower palm portion.

7. The protective sports glove of claim 1, further comprising:

a first portion of a hook and loop fastening system coupled to an inner side of said lower palm region, said first portion selected from the group consisting of a hook portion and a loop portion; and a second portion of said hook and loop fastening system coupled to said palm portion of said form-fitting inner glove, said second portion selected from the group consisting of said hook portion and said loop portion, said second portion being opposite from said first portion, wherein said second portions is coupled to said palm portion such that it is capable of being reversibly coupled to said first portion.

8. The protective sports glove of claim 1, said inner glove further comprising:

a back portion;

a plurality of finger portions coupled to and extending from said palm portion and said back portion; and a thumb portion coupled to and extending from said palm portion and said back portion, at least one of said finger portions and said thumb portion circumferentiating a wearer's finger or thumb so that said inner glove is fixedly joined with the wearer's hand independent of said outer glove.

9. The protective sports glove of claim 1, wherein said palm portion of said inner glove includes at least one tackified region formed in an area that extends below said lower border of said outer padded glove.

10. The protective sports glove of claim 1, wherein said palm portion of said inner glove is formed of a thin durable material selected from the group consisting of leather, cloth, synthetic leather, natural fabrics, synthetic fabric, elastic materials and polymeric materials.

11. The protective sports glove of claim 3, said inner glove further comprising a back portion having at least one opening, said at least one opening corresponding to said plurality of vent openings and there providing ventilation to a back side of a wearer's hand.

12. A multi-portion protective sports glove comprising:

a padded outer glove including a hand portion for receipt of a wearer's hand, said hand portion comprising an inner palm portion and an opposing backside portion, said inner palm portion defining an opening therein, said opening aligning with a palm of said wearer's hand, said inner palm portion including a lower palm region having a lower border, said lower border defining an opening extending within the interior of said hand portion towards said wearer's hand and wherein said opposing backside portion includes a plurality of pads disposed thereon;

a plurality of finger portions joined with said padded outer glove and extending from said hand portion for receipt of a wearer's fingers therein, each of said plurality of finger portions including a finger palm portion and an opposing padded finger portion; and a thumb portion on said padded outer glove secured to and extending from said hand portion for receipt of a wearer's thumb therein, said palm portion including a thumb palm portion and an opposing padded thumb portion; and an inner glove that is selectively positioned at least partially within said padded outer glove, said inner glove including a palm portion joined with at least one of a finger portion, a wrist portion and a thumb portion, said palm portion aligned with said opening in said padded outer glove so that said inner glove palm portion is exposed through said opening in said inner palm portion of said padded outer glove; said at least one of said finger portion, said wrist portion and said thumb portion circumferentiating at least one of said wearer's finger, wrist and thumb, respectively, to independently join said inner glove with said wearer's hand.

13. The padded outer glove of claim 12 further comprising a cuff portion coupled to said hand portion.

14. The padded outer glove of claim 12 further comprising a plurality of vent openings formed in said backside portion of said hand portion.

15. The padded outer glove of claim 12 further comprising a wrist guard coupled to said hand portion.

16. The padded outer glove of claim 12 further comprising at least one mesh portion coupled within said inner palm portion, said finger palm portion, or said thumb palm portion, said at least one mesh portion located in an area not intended to primarily contact a stick during use.

17. The padded outer glove of claim 12, wherein said lower palm portion includes at least one series of perforations, said at least one series of perforations defines a removable portion of said lower palm portion to adjust the size of said opening.

* * * * *